United States Patent [19]

Nordlund

[11] 4,343,172

[45] Aug. 10, 1982

[54] TOOL HOLDERS AND A METHOD OF THEIR MANUFACTURE

[75] Inventor: Sven P. Nordlund, Ostvik, Sweden

[73] Assignee: Svenor Modul-System AB, Lulea, Sweden

[21] Appl. No.: 76,599

[22] Filed: Sep. 18, 1979

[30] Foreign Application Priority Data

Sep. 19, 1978 [SE] Sweden ..... 7809819

[51] Int. Cl.[3] ..... B21D 53/00

[52] U.S. Cl. ..... 72/339; 72/379; 211/60 A; 211/60 T

[58] Field of Search ..... 211/60 A, 60 T, 72, 211/73; 113/116 G, 116 F, 116 V, 116 BB, 116 HH, 116 A; 29/150; 72/379, 339

[56] References Cited

U.S. PATENT DOCUMENTS

| | | | |
|---|---|---|---|
| 2,145,073 | 1/1939 | Drake | 113/116 A |
| 2,294,006 | 8/1942 | Thorsheim | 211/73 |
| 2,805,777 | 9/1957 | Larson | 211/60 A |
| 2,815,863 | 12/1957 | Larson | 211/60 T |
| 3,062,380 | 11/1962 | Grela et al. | 211/73 |
| 3,698,563 | 10/1972 | Gordon et al. | 211/60 A |
| 3,737,131 | 6/1973 | Larson | 211/60 T |

FOREIGN PATENT DOCUMENTS

| | | | |
|---|---|---|---|
| 807494 | of 0000 | Canada . | |
| 2549554 | 5/1977 | Fed. Rep. of Germany | 211/60 T |
| 2707585 | 8/1978 | Fed. Rep. of Germany | 211/60 T |
| 714703 | of 0000 | United Kingdom . | |
| 1021787 | of 0000 | United Kingdom . | |
| 1142180 | of 0000 | United Kingdom . | |
| 1489463 | of 0000 | United Kingdom . | |
| 1543383 | of 0000 | United Kingdom . | |
| 1586965 | of 0000 | United Kingdom . | |
| 2022505 | of 0000 | United Kingdom . | |

*Primary Examiner*—Lowell A. Larson
*Attorney, Agent, or Firm*—Fleit & Jacobson

[57] ABSTRACT

Present day tool-holders or tool-holder systems for general work-shop or hobby-room use are generally manufactured from a large number of different blanks, e.g. one blank for each tool-holder configuration. This invention relates to tool-holders manufactured from a respective one of three starting blanks or strips cut therefrom and having arranged therein at least two mutually adjacent rows of openings. The openings of one row may be of greater area than the openings of the other row, or an opening of a given row may be of greater area than another opening in said row. A blank is cut and/or folded in a particular manner to form a holder for supporting a variety of tools, such as hammers, screw-drivers, and holemaking or piercing tools, or for supporting a single kind of tool.

12 Claims, 14 Drawing Figures

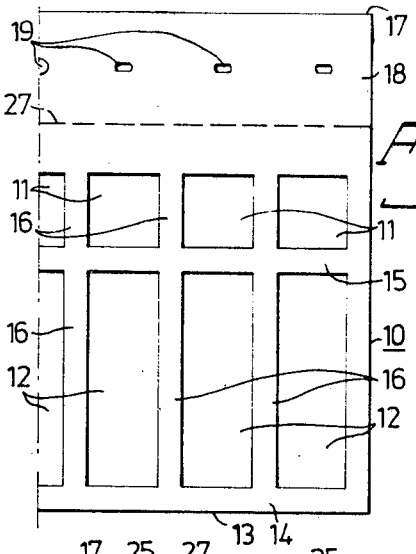
Fig. 1
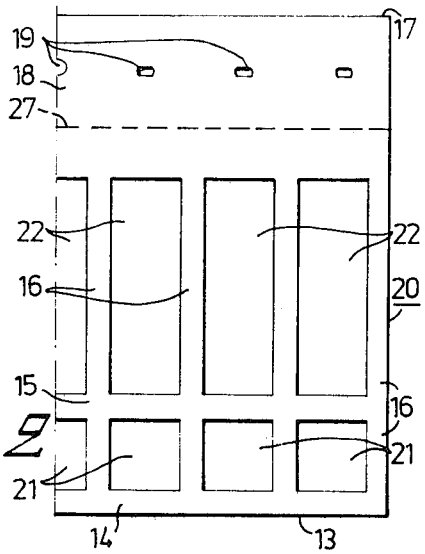
Fig. 2
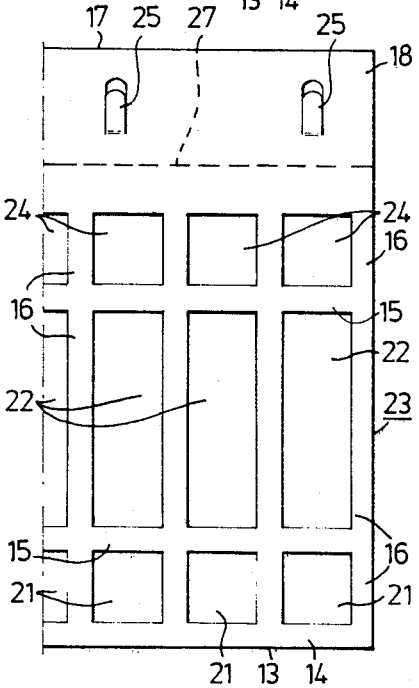
Fig. 3
Fig. 4
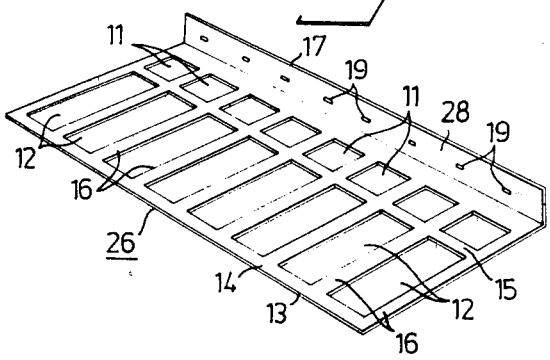
Fig. 5
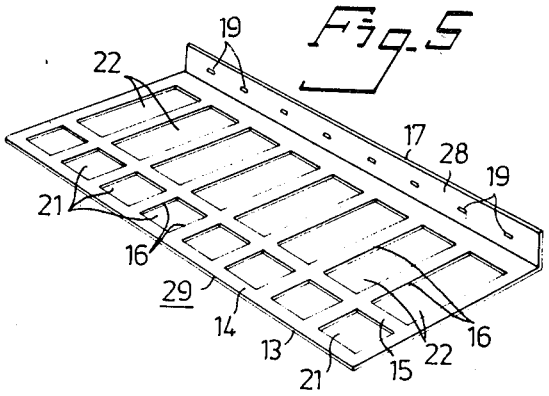

TOOL HOLDERS AND A METHOD OF THEIR MANUFACTURE

The present invention relates to tool holders and a method of their manufacture.

Tool holders or tool-holder systems at present known are generally encumbered with the disadvantage that several different kinds of starting blanks and working methods are required for their manufacture. Furthermore, tool holders of conventional design and manufactured according to conventional methods are only able to carry a relatively small number of tools in relation to the space they take up.

An object of the present invention is to provide an improved tool holder and a novel and useful method by means of which said tool holders can be manufactured.

According to one aspect this invention consists in a tool holder comprising a strip of material having arranged therein and spaced from one longitudinal edge thereof at least two rows of tool-accommodating openings, which rows extend in the longitudinal direction of the strip and an attachment-flange which is formed by a portion of said strip located between said one edge and the row of tool-accommodating openings nearest thereto, and which extends substantially at right angles to the plane of said nearest row of openings, said flange being for mounting said holder to a holder-support surface.

According to another aspect this invention consists in a method of manufacturing a tool holder comprising producing a strip of material, forming in said strip in the longitudinal direction thereof at least two rows of openings spaced from one longitudinal edge of said strip, and folding a portion of said strip located between said one edge and the row of openings nearest thereto, to form an attachment flange which extends substantially at right angles to the plane of said nearest row of openings, said flange being for mounting said holder on a holder-supporting surface. By means of the method a tool holder generally suitable for any type of tool, e.g. for workshop use, hobbies and household purposes etc., can be manufactured from one or just a few types of starting blanks whilst applying only punching and folding or bending methods, whereby manufacture of the tool holders can readily be automatized. The tool holders produced in accordance with the method have a high capacity, i.e. they are able to carry a large number of tools within a limited space.

Although the above specified method steps may be carried out in any suitable order, conveniently, said rows of openings are formed in a strip-like blank having a length which exceeds the length of the tool holder to be manufactured, wherein the thus perforated blank is subsequently cut in its transverse direction into strips corresponding to the desired length of a respective tool holder.

Conveniently, there are rows of openings of substantially rectangular shape, the sides of the openings in mutually adjacent rows being of different length when seen in the cross-direction of the strip or of the blank. In this way considerable material can be saved and a holder is obtained which can accommodate various types of tools, such as both pliers and screwdrivers or piercing and pointed tools.

For the purpose of obtaining straight, unbroken end surfaces and to increase the tool-holding capacity of a tool holder and to reduce wastage when cutting the perforated blank, the mutually adjacent rows of openings are formed opposite one another and the length of the sides of said openings are mutually the same when seen in the longitudinal direction of the strip or the blank.

For the purpose of saving further material, the blank or strip is preferably perforated in a manner such that the openings of the rows of openings are formed so close to one another that they are separated by opening-defining bars having a width which is smaller than the smallest width of said openings, said bars extending in the longitudinal and transverse direction of said strip or said blank.

If it is wished to adapt the tool holders in a relatively simple manner to accommodate relatively large tools, at least one of said opening-defining bars extending in the longitudinal and/or transverse direction of said strip or said blanK is completely or partially removed to form tool-accommodating openings having sides of greater length in the transverse and/or longitudinal direction of said blank or said strip than the original openings in said rows of openings.

For the purpose of adjusting the tool holder to receive tools which to facilitate hanging of the same, are provided with holes or with parts which project out from the side of a handle or the like, such as carpenter's hammers, club hammers or mallets, at least one of the opening-defining bars extending in the longitudinal direction of the blank or the strip, is completely or partially removed to form at least one tongue which projects from said blank or said strip and which comprises one transverse opening-defining bar or two mutually adjacent transverse opening-defining bars and at least one longitudinally extending opening-defining bar connecting said two mutually adjacent transverse opening-defining bars, wherewith for the purpose of securng the tool in question in a more positive manner it is also suitable for the tongue to be folded outwardly or bent outwardly from the plane of remaining opening-defining bars to form a hook or an upstanding peg. The upstanding pegs thus obtained can, to advantage, be used for holding sleeve-type tools, such as box spanners, socket spanners, hole punches etc.

Alternatively, tool holders having hooks, from which tools can be hung, and upstanding pegs can be manufactured by cutting at least one of the opening-defining bars extending in the transverse direction of the blank or strip adjacent one opening-defining bar extending in the longitudinal direction of the blank or strip to form a tongue which is bent out or folded out from the plane of remaining opening-defining bars to form a hook or an upstanding peg.

When manufacturing tool holders for elongate tools which are held in an upstanding position or hung from the holder and which require side supports at two locations along their length, a blank or strip having two rows of openings in which the sides of the openings in the row of openings located furthest away from the attachment flange are longer in the transverse direction of the blank or strip than the openings of the other row of openings, the blank or strip is bent along a line extending in the longitudinal direction of the blank or strip in the transition region between the two rows of openings in a manner such that the edge of the blank or strip located furthest away from the portion forming said attachment flange is placed substantially in the plane of said attachment flange.

Alternatively, a blank or strip having three rows of openings is folded along two lines extending longitudinally of said blank or a strip in a manner such that the openings in the rows of openings separated by the centre row of openings are placed substantially centrally above one another in spaced-apart relationship.

In the case of upstanding tools, there may additionally be arranged a separate support at the lower tool-end.

When manufacturing a holder for, for example, substantially rectangular tools, such as small planes, rules etc., the blank or strip is separated from the attachment flange along a part of the length of said blank or said strip, said part being folded at substantially right angles to the plane of the remaining part still connected to the attachment flange.

The invention will now be described in more detail with reference to the accompanying schematic drawings, which illustrate a number of examples of perforated blanks manufactured in accordance with the invention and tool holders manufactured from said blanks. Identical or substantially identical elements are identified by the same references in the various Figures.

FIGS. 1–3 illustrate in plan view parts of three different perforated blanks from which tool-holders can be produced in accordance with the invention.

FIGS. 4 and 5 illustrate in perspective tool holders produced from the perforated blanks shown in FIGS. 1 and 2, respectively.

Figure 6:
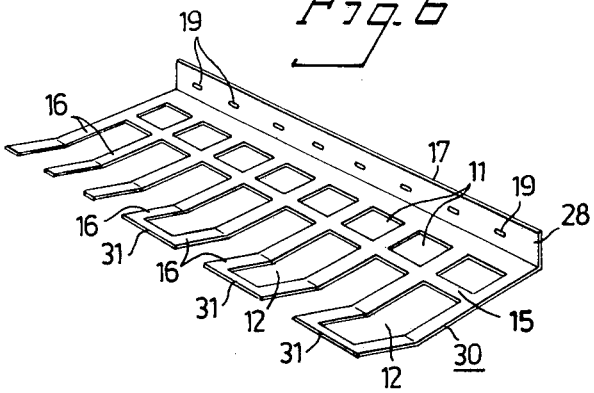
FIGS. 6–11 are perspective views of tool holders produced from a perforated blank according to FIG. 1.

In FIG. 1 there is shown a part of a blank 10 in strip form which, by punching, has been provided with two rows of openings 11 and 12 prespectively. The openings 11, 12 in the two rows are located opposite one another and the sides of the holes when seen in the longitudinal direction of the blank or strip 10 are of the same length, but are of different length when seen in the transverse direction of the strip or blank. The openings 11 of the inner row of openings are substantially square and the length of each of the sides of said openings may reach to about 12 mm, while the length of the sides of the openings 12 in the row of openings located adjacent one long edge 13 of the blank 10 when seen in the transverse direction of the blank is about 3 times the length of the sides when seen in the longitudinal direction of the blank. The openings 11 and 12 are located adjacent each other such as to be separated by opening-defining strips or bars 14, 15, 16 extending in the longitudinal and transverse direction of the blank 10 and having a small width in comparison with the smallest cross dimension of the openings 11, 12. The openings 11 of the innermost row are located at a distance from the long edge 17 of the blank 10 opposite the long edge 13 such that there is located between said edge 17 and the inner row of openings 11 a relatively wide strip portion 18. As illustrated, this portion 18 may be provided with a row of holes 19, also by punching, for mounting a tool holder formed from the blank 10 in a manner hereinafter mentioned on a vertical carrier surface or plate.

In FIG. 2 there is shown a part of a modification of the blank 10 according to FIG. 1. In the blank 20 illustrated in FIG. 2 the openings 21 in the row of openings located nearest the edge 13 coincide substantially with the openings 11 of the FIG. 1 embodiment, while the size and shape of the openings 22 in the inner row of openings coincide substantially with the openings 12 in FIG. 1. The perforated blanks 10 and 20 shown in FIGS. 1 and 2 respectively are, in other respects, similar to one another.

FIG. 3 illustrates a modification of the perforated blank 20 shown in FIG. 2. In this modification the perforated blank 23 is wider and is provided with a further row of openings 24 between the strip part 18 and the row of openings 22. Instead of the holes 19 of the FIG. 2 embodiment, the FIG. 3 embodiment is provided with attachment tabs 25 which are formed in a substantially L-shape by punching and folding in a manner such that they exhibit, seen in FIG. 3, a part which is downwardly directed from the plane of the Figure and a part angled from the first-mentioned part and parallel with the strip portion 18.

FIG. 4 illustrates a tool holder 26 manufactured from the perforated blank shown in FIG. 1, said holder being formed by cutting a piece of the blank 10 and bending the strip portion 18 shown in FIG. 1 through substantially 90° along the dash line 27, to form an attachment flange 28. The tool holder, FIG. 4, which is suitable for holding pliers, screwdrivers, piercing and pointed tools etc. in the two rows of openings 11, 12, is intended to be screwed to a carrier surface, said screws (not shown) being inserted through two or more holes 19 and anchored in the carrier surface in a manner to press the flange 28 thereagainst. The carrier surface may comprise a sheet, for example, of masonite provided with holes, e.g. a peg-board, the distance between the holes 19 and the holes in said sheet coinciding with one another, for example in a manner such that the distance between adjacent holes 19 in the attachment flange are equal to or twice or half as long as the distance between adjacent holes in the carrier plate.

FIG. 5 illustrates a tool holder 29 formed from the perforated blank 20 shown in FIG. 2, said tool holder being obtained by cutting the blank 20 and folding the strip portion 18 along the line 27 to form an attachment flange 28. This tool holder also exhibits two rows of openings 21, 22 for receiving such tools as pliers, screwdrivers, piercing and pointed tools etc.

The perforated blank 23 shown in FIG. 3 can be formed into a tool holder having three rows of openings 21, 22, 24 by cutting the blank and folding the strip portion 18 along the line 17 in a manner similar to that described with reference to FIGS. 4 and 5, said openings being intended to receive tools.

FIG. 6 illustrates a tool holder 30 formed from a blank shown in FIG. 1, and can be considered a further development of the tool holder shown in FIG. 4. Thus, in the FIG. 6 embodiment parts of the outer longitudinally extending opening-defining bar (14 in FIG. 1) have been removed and the transverse opening-defining bars 16 have been folded upwardly through about 30° to form firstly narrow tongues each comprising an outer part of a bar 16, and partly relatively wide tongues each of which is formed by outer parts of two adjacently located bars 16 and a part 31 of the outer opening-defining bar joining said strips 16. In the tool holder 30, the openings 11 in the inner row of openings can be used for carrying, for example, screwdrivers or piercing and pointed tools, while the tongues can be used for carrying such tools as certain types of adjustable spanners which have holes by which they may be hung, or for supporting tools having portions which project outwardly from a handle or shaft or the like, such as carpenters' hammers, club hammers or mallets.

Figure 7:
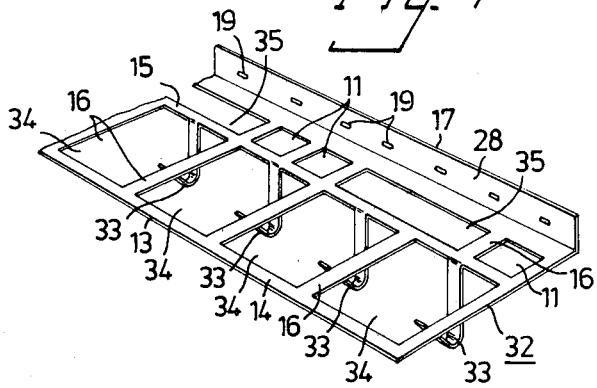

The tool holder 32 shown in part in FIG. 7 has been formed from a piece of a blank 10 shown in FIG. 1, by folding the strip portion 18 along the line 27. Further, each alternate transverse opening-defining bar 16 has been cut adjacent the longitudinally extending opening-defining bar 14, and the transverse part of these bars 16 located between the bar 14 and the bar 15 has been bent to form tool-carrying hooks 33. In addition, there is also formed by the bars 14 and 15 and the uncut bars 16 de-limited, relatively large openings 34, which can be used for accomodating tools. In addition, certain of the parts of the bars 16 separating mutually adjacent openings 11 have been removed, thereby to form elongate openings 35 for receiving plier-like tools etc.

Figure 8:
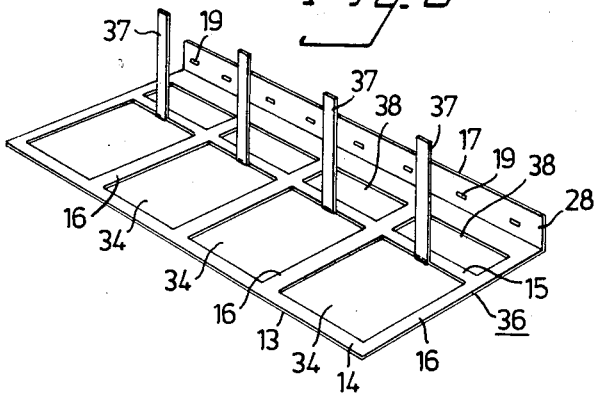

The tool holder 36 illustrated in FIG. 8 is formed from a piece of the blank 10 shown in FIG. 1, by folding the strip portion 18 along the line 27, removing each alternate part of the transverse opening-defining bars 16 separating the mutually adjacent openings 11, and cutting each alternate transverse bar 16 adjacent the longitudinally extending opening-defining bar 14. The parts of the bars 16 thus cut at their respective one ends have been folded to form pegs 37 for carrying, e.g, sleeve-like tools. The formed elongate inner openings 38 can be used for receiving pliers, small adjustable spanners etc., and the relatively large openings 34 defined by the bars 14, 15 and the remaining bars 16 can also be used for receiving tools.

Figure 9:
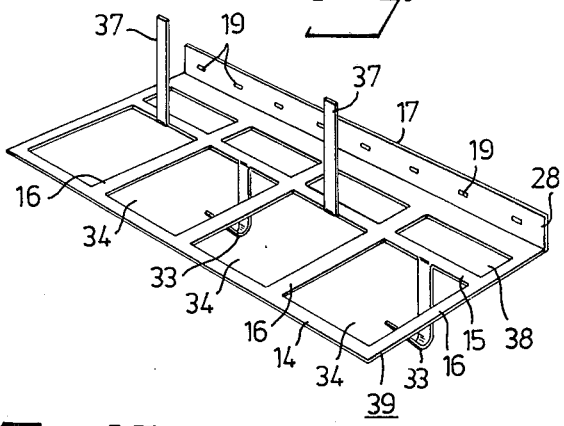

The tool holder 39 illustrated in FIG. 9 is substantially the same as the tool holder shown in FIG. 8. The only difference is that each alternate part of the transverse opening-defining bars 16 cut adjacent bar 14 has been bent to form tool-suspending hooks 33.

Figure 10:
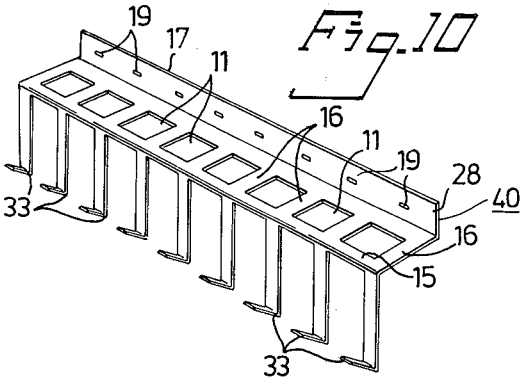

The tool holder 40 illustrated in FIG. 10 has also been formed from a blank 10 according to FIG. 1, by folding the strip portion 18 along the line 27 and removing the outer longitudinally extending opening-defining bar 14. The thus formed tongues projecting out from the opening-defining bar 15 have been bent to form hooks 33 from which tools can be hung. The openings 11 can be used, for example, for carrying screwdrivers or piercing and pointed tools.

Figure 11:
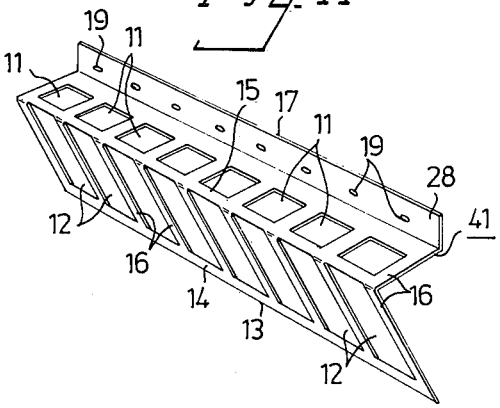

The tool holder 41 illustrated in FIG. 11 has been formed from a blank 10 shown in FIG. 1, by folding the strip portion 18 along the line 27 and bending down the part of the blank located outside the opening-defining bar 15 in a manner such as to place the edge 13 in substantially the same plane as the attachment flange 28. In this way, the openings 11 are placed above the openings 12 and are thus suitable for accommodating tools which need to be supported at two different levels along their length.

Figure 12:
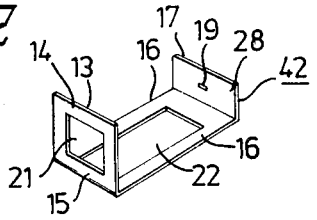
FIG. 12 is a perspective view of a tool holder produced from a perforated blank according to FIG. 2.

FIG. 12 illustrates a tool holder 42 formed from a part of a blank 20 according to FIG. 2, said tool holder 42 being formed by folding the strip portion 18 along the line 27 and bending up the outer part of the blank immediately inwardly of the opening-defining strip 15. In this way there is obtained a bracket-like structure which, for example, in combination with one or more similar bracket-like structures can be used for carrying elongate tools which are best lain on their sides.

Figure 13:
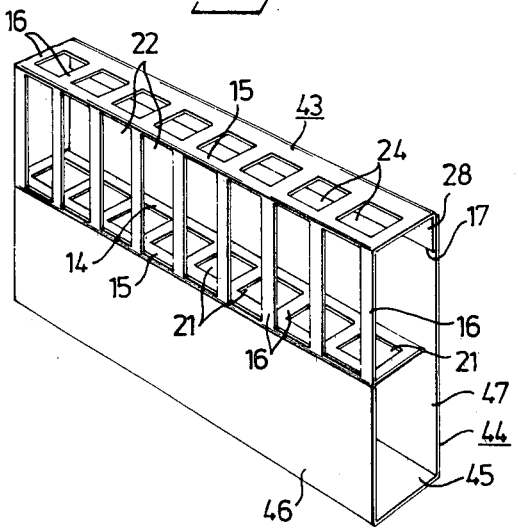
FIGS. 13 and 14 are perspective views of tool holders produced from a blank according to FIG. 3.

FIG. 13 illustrates a tool holder 43 formed from a part of a blank 23 according to FIG. 3. In this embodiment, however, the blank 23 is assumed to have been provided with attachment holes corresponding to the holes 19 in the FIG. 2 embodiment. The tool holder has been formed by folding down the strip portion 18 through 90° along the line 27, to form a downwardly extending attachment flange 28, downwardly folding the part of the blank 23 located outside the inner opening-defining bar 15 through 90°, and inwardly folding the part of the blank located nearest the edge 13 through 90° immediately inwardly of the outer of the opening-defining bars. In this way, the openings 24 and 21 are placed centrally above each other and there is obtained a tool holder which can be used in substantially the same manner as that described with reference to FIG. 11. For the purpose of providing a lower support for the tools placed in the holder 43, there is also arranged a substantially U-shaped sweep 44 having a horizontal web 45, the upper side of which may be covered with a soft covering (now shown) to protect, for example, the edge of a chisel or cutting tool carried in the holder 43. The sweep 44 also exhibits a short leg 46, which terminates adjacent the lower bar 15, and a longer leg 47, which extends up behind the attachment flange 28 and may be provided at its upper end with attachment holes opposite the attachment holes in the flange 28, thereby to enable it to be mounted to a carrier surface with the aid of the same attachment means as those used for mounting the holder 43 on said carrier surface. It will be understood that a sweep, similar to the sweep 44, can also be used in conjunction with the tool holder shown in FIG. 11.

Figure 14:
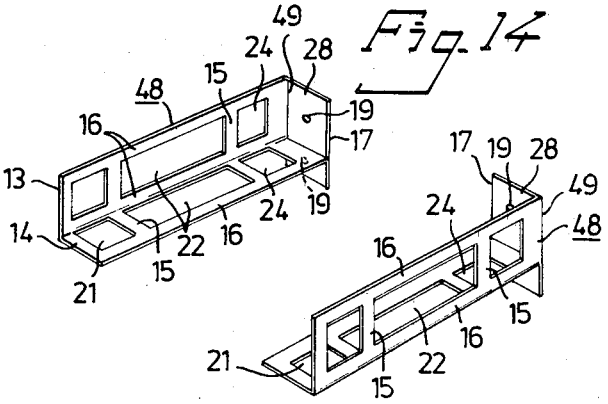

FIG. 14 illustrates two tool holders 48 formed from pieces of the blank 23 according to FIG. 3, said tool holders being intended to cooperate with one another. Each holder has been formed by folding the strip portion 18 up along the line 27 to form an attachment flange 28. Further, a piece of the blank along a part of its length has been separated from the attachment flange 28 along the line 27, and this piece has been folded outwardly at substantially 90° to the plane of the remaining part still connected to the attachment flange 28 at 49.

The invention is not restricted to the aforedescribed and illustrated embodiments, but can be modified within the scope of the following claims.

The invention also includes a perforated blank for manufacturing tool holders, said blank having the form of an elongate strip or rectangular piece, preferably made of metal, in which there has been formed at least two mutually adjacent rows of openings, said rows extending in the longitudinal direction of said blank and being located at a distance from one longitudinal edge thereof in a manner such that there is present along said edge an imperforate strip. Further, the invention includes a blank profile for manufacturing tool holders, which profile may have the form of an elongate piece preferably comprising a metal, in which piece there is formed at least two mutually adjacent rows of mutually adjacent through-passing openings, said rows extending in the longitudinal direction of said piece and being located at a distance from one longitudinally extending edge thereof in a manner such that there is provided along said edge a strip which is free from such openings, said strip being folded at substantially right angles to the basic plane of the part provided with said openings.

I claim:

1. A method of manufacturing a tool holder, comprising the steps of:

(a) producing a strip of material;

(b) forming in said strip in the longitudinal direction thereof at least two mutually parallel rows of rectangular tool-receiving apertures spaced from one longitudinal edge of said strip, the apertures of one row being located immediately opposite respective apertures of an adjacent row and the transverse length of the apertures in one row being greater than the transverse length of the apertures in said adjacent row, while the longitudinal length of the apertures of said rows are equal, and said apertures being defined by at least three defining bars which are integral with the strip and the width of which is small in comparison with the smallest width of any aperture; and (c) folding a portion of said strip located between said one longitudinal edge and the row of apertures nearest said edge to form a mounting flange substantially at right angles to the plane of said nearest row.

2. A method of manufacturing a tool holder according to claim 1, wherein in step (b) at least some of the apertures in the row of apertures furthest from the mounting flange are formed so as to be defined by two mutually adjacent transverse defining bars and one longitudinal defining bar which is common to a respective one of the apertures of an adjacent row, said method comprising a further step (d) in which the distal ends of the transverse bars defining the apertures in said furthest row are bent upwardly out of the plane of an adjacent row of apertures.

3. A method of manufacturing a tool holder according to claim 1, wherein in step (b) selected first apertures in the row of apertures furthest from the mounting flange are formed so as to be defined by two mutually adjacent transverse defining bars and two longitudinal defining bars and separated by at least one second aperture defined by two mutually adjacent transverse bars and a longitudinal bar which is common to a respective one of the apertures of an adjacent row, said method comprising a further step (d) in which the distal ends of at least the transverse bars defining said first apertures are bent upwardly out of the plane of an adjacent row of apertures.

4. A method according to claim 1, comprising the further step (d) of severing alternate transverse aperture defining members in the row of apertures furthest from the mounting flange at the distal end of said apertures, and bending the distal ends of the downwardly extending members to form hooks.

5. A method according to claim 1, comprising the further step (d) of severing alternate transverse aperture defining members in the row of apertures furthest from the mounting flange at the distal end of said apertures, and bending said severed defining members upwardly to form upstanding pegs.

6. A method according to claim 1, comprising the further step (d) of severing alternate transverse aperture defining members in the row of apertures furthest from the mounting flange at the distal end of said apertures, and bending some of said severed defining members upwardly, to form upstanding pegs, and the remainder downwardly, and bending the distal ends of the downwardly extending members to form hooks.

7. A method according to one of claims 4, 5, or 6, comprising omitting at least some of the transverse defining members in the row of apertures nearest the mounting flange.

8. A method according to claim 1, comprising the further step (d) of bending the row of apertures furthest from the mounting flange through 90° on a medial line extending parallel to the distal longitudinally extending defining bars, so as to form a substantially U-shaped tool holder.

9. A method according to claim 1, in which in step (b) the strip is given three rows of mutually parallel and mutually opposite rectangular apertures, and in which the row of apertures of greater transverse length is located intermediate of the other two rows, said method comprising the further step (d) of bending the apertured strip along medial lines extending longitudinally of the strip in a manner such as to place the apertures of one of said other rows centrally above and in vertical alignment with respective apertures of the other of said other rows, with the apertures of greater transverse length located therebetween but lying in a plane at right angles to the plane of the apertures in said other rows.

10. A method according to claim 1, comprising the further step (d) of bending the strip on a medial line extending longitudinally along the strip between the furthest row of apertures from the mounting flange and the row of apertures immediately adjacent said furthest row, so that a distal edge of said furthest row of apertures lies approximately in the plane of the mounting flange.

11. A method according to claim 1, in which in step (b) all the rectangular apertures of the row furthest from the mounting bracket are defined solely by two transverse members and one longitudinal member, which is common to a respective aperture of said furthest row and an opposite aperture of an immediately adjacent row, said method comprising the further step (d) of bending said transverse members downwardly at their inner ends along a medial line extending longitudinally of the strip, and bending the distal ends of said transverse members upwardly to form hooks.

12. A method according to claim 1, comprising the further step (d) of separating the apertured strip from the mounting flange along part of the length of the strip, and folding said separated strip part substantially at right angles to the plane of the strip part still attached to said flange.

* * * * *